United States Patent [19]

Monjo-Rufi

[11] 4,423,817

[45] Jan. 3, 1984

[54] SHELF RACK

[76] Inventor: Jesus Monjo-Rufi, Lázaro Cárdenas, 1., Barcelona, Spain

[21] Appl. No.: 290,422

[22] Filed: Aug. 6, 1981

[30] Foreign Application Priority Data

Aug. 8, 1980 [ES] Spain ..... 252.761

[51] Int. Cl.[3] ..... A47B 57/04

[52] U.S. Cl. ..... 211/187; 211/191; 211/192

[58] Field of Search ..... 211/186, 187, 189, 190, 211/191, 192

[56] References Cited

U.S. PATENT DOCUMENTS

| | | | |
|---|---|---|---|
| 3,468,430 | 9/1969 | Lawman | 211/191 X |
| 3,702,137 | 11/1972 | Evans | 211/187 X |
| 4,088,229 | 5/1978 | Jacoby et al. | 211/191 |
| 4,244,476 | 1/1981 | Tang | 211/192 |
| 4,262,809 | 4/1981 | McConnell | 211/192 |

FOREIGN PATENT DOCUMENTS

| | | | |
|---|---|---|---|
| 1288266 | 1/1969 | Fed. Rep. of Germany | 211/187 |
| 2461841 | 3/1981 | France | 211/192 |

*Primary Examiner*—William E. Lyddane
*Assistant Examiner*—Peter A. Aschenbrenner
*Attorney, Agent, or Firm*—Wigman & Cohen

[57] ABSTRACT

A rack for a removable shelf comprises a pair of profiled vertical joints with generally U-shaped cross-sections, cross-member braces for linking together the pair of profiled vertical joints to form a unit, and interlinkable longitudinal beams also for connecting together the pair of profiled vertical joints. Two longitudinal rows of slanted apertures are provided along the length of each one of the pair of profiled vertical joints for fitting together the pair of profiled vertical joints with the interlinkable longitudinal beams. The apertures are arranged in pairs equidistant from each other and converge symmetrically together downwards. Each of the apertures has a contour which takes the approximate shape of an irregular pentagon. Angular sections are provided at each end of the interlinkable longitudinal beams for fitting these beams with the pair of profiled vertical joints. A free wing is included as a part of each of the angular sections for jutting out in a plane parallel to the length of each of the pair of profiled vertical joints. A tongue is provided in the free wing for fitting into at least one of the apertures. A safety bolt is formed as a mainly S-shaped shank for interlocking the tongue into at least one of the apertures. The safety bolt has one end branch arranged to extend through the free wing in which the tongue is provided and has the other end branch arranged to extend through at least one of the apertures.

7 Claims, 7 Drawing Figures

25
24
1
10
9
7a
III
17
16
18
22
23
2
IV
4
V
8
3
11
19
6

SHELF RACK

BACKGROUND OF THE INVENTION

The present invention refers to a rack for a set of shelves of the type which include vertical frames, comprising a pair of profiled vertical joints, generally U-Sectioned, interlinked by cross members and bracing forming a unit, and characterized by interlinkable connecting longitudinal beams with the frames, through their own linking parts. Each vertical joint in the branch of the section parallel to the longitudinal direction of the shelves is provided with two longitudinal rows of slanting apertures for fitting, which, through equidistant pairs, converge symmetrically together downwards, and which are provided in their bottom part on the inside, with two bevelled narrow parts, so that in their contour they adopt the approximate shape of an irregular pentagon, determining between the two pentagonal apertures of each pair, a relatively wide central bridge. These connecting longitudinal beams are made up of joists which at their ends have two angular section parts joined to the head, arranged so that their free end juts out in a parallel plane to the longitudinal direction of the joist, whereas the other wing stretches in a perpendicular plane to that direction. The free wing is provided with at least one fitting tongue in the pentagonal apertures of the vertical joints, formed by pressing in a rectangular shaped portion, guided slanting wise with respect to the vertical.

SUMMARY OF THE INVENTION

In essence, the removable shelves of the present invention are characterized in that each vertical joint, symmetrical with respect to its middle longitudinal vertical plane, is provided on each side branch with a portion first bent inwards and then outwards, which forms a longitudinal groove with an isosceles trapezoid section in the outer face of the side branch. In the center of the groove, there is a longitudinal series of equidistant orifices, and a series of holes is also made vertically aligned and equidistant, in the central bridge, between the two vertical and symmetrical rows with essentially pentagonal apertures.

Other characteristics and advantages of the shelves of the present invention will be gathered from the following description made in connection with the attached drawings, which illustrate, by way of example, a form of embodiment thereof.

DESCRIPTION OF THE PREFERRED EMBODIMENTS

In these drawings, it can be seen that the removable shelves include frames made up of a pair of vertical joints 1, like pillars, with a general U-section, interlinked by cross-members and bracing 2, forming a unit, and by connecting longitudinal beams 3, which can be coupled and removed from the vertical joints 1.

In the branch of each vertical joints 1 of the section parallel to the longitudinal direction of the shelves, there are two longitudinal rows of slanting fitting apertures 4, which converge symmetrically downwards by equidistant pairs.

Figures 3, 4, 5, 6, 7:
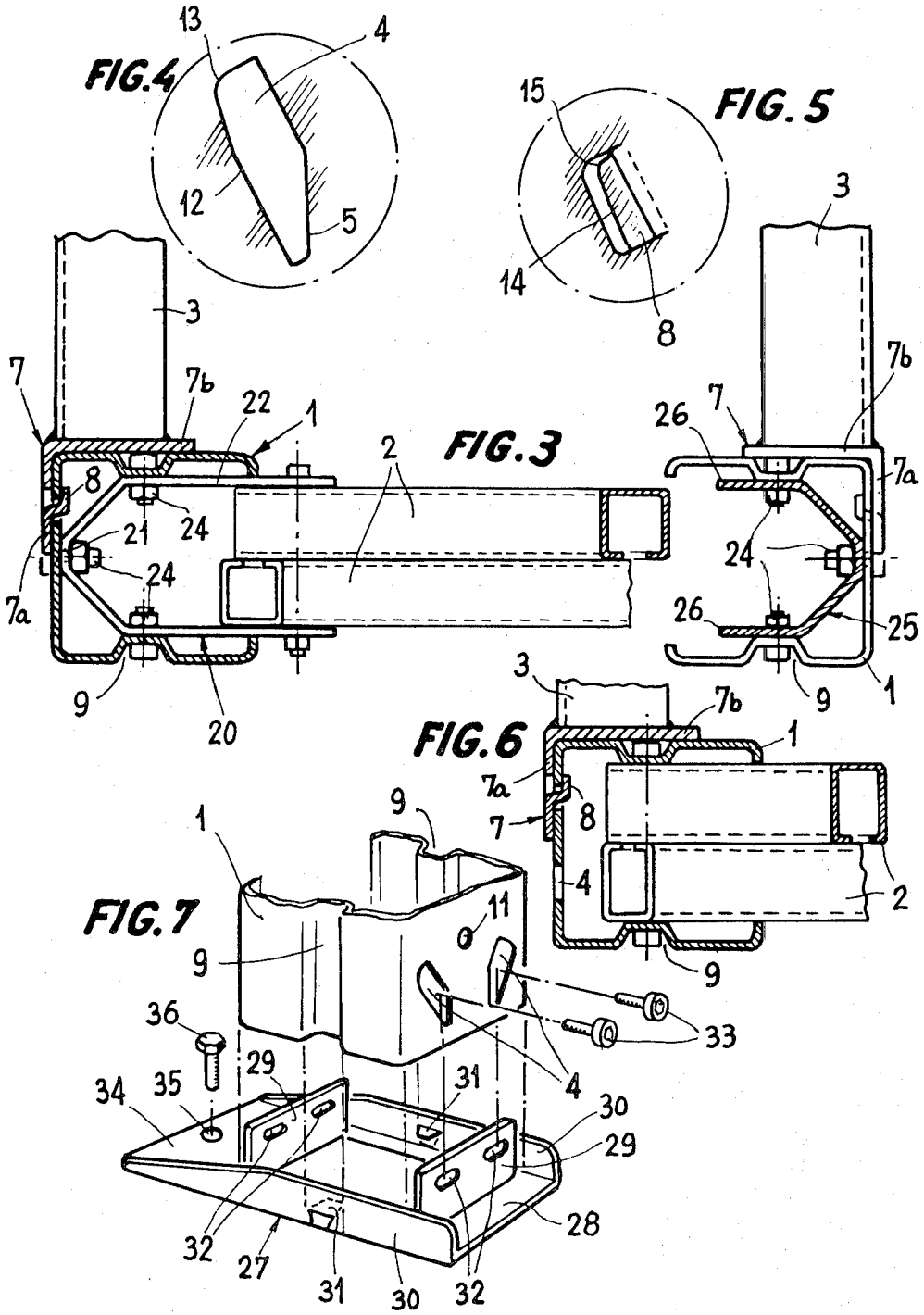
FIG. 3 illustrates a cross section view taken along line III—III of FIG. 1.
FIGS. 4 and 5 are both details, on an enlarged scale, taken along line IV and V, respectively, of FIG. 2.
FIG. 6 shows a cross-section view of a braced vertical joint.
FIG. 7 illustrates a perspective view of the foot of a vertical joint and a base part, separated but in a correlative fitting position.

Each of these apertures 4, whose detail can be seen enlarged in FIG. 4, is provided in its bottom part, on the inside, with a narrowing bevel edge 5, and takes the approximate shape of an irregular pentagon. A relatively wide central bridge 6 is formed in the vertical joint 1, between the two apertures 4 of each pair.

The longitudinal connecting beams 3 are made up of joists which at their ends have two angular section parts 7 joined to the head, in which their free wing *7a* juts out in a parallel plane to the longitudinal direction of the beam 3, whereas the other wing *7b* stretches in a perpendicular plane to that direction.

The free wing *7a* is provided with three fitting tongues 8, vertically aligned and spaced at an identical distance to that which the apertures 4 are separated, adapted to be inserted into the three corresponding pentagonal apertures 4 of the vertical joint 1. Each of these tongues 8 is formed by pressing a generally rectangular shaped portion inwards, guided slantingly with respect to the vertical axis (FIG. 5).

Each vertical joint 1, symmetrical with respect to its middle longitudinal vertical plane, is provided in each side branch with a portion bent first inwards and then outwards, which portion forms a longitudinal groove 9 with an isosceles trapezoid section in the outer side of the side branch. In the center of this groove 9, there is a series of equidistant longitudinal orifices 10.

On the other hand, in the central bridge 6, between two vertical and symmetrical rows of apertures 4, a series of holes 11 has been made, also vertically aligned and equidistant.

In FIG. 4, the apertures 4, which are essentially pentagonal, have a larger outer edge 12 forming an obtuse angle close to 180° and an upper corner 13 of that outer edge 12 is slightly rounded.

In turn, as shown in FIG. 5, the tongues 8 have their outer free edges 14 gently converging towards the top edges, top corners 15 being likewise rounded.

A safety bolt 16 has been provided by a mainly S-shaped shank (FIG. 2) with a top outer branch 17 slightly less than half the length of the other lower outer branch 18, and adapted to be arranged with its intermediate branch astride the bottom edge of a small aperture 19 made in the free wing *7a* joined to the angular section part 7 of the longitudinal beam. The small aperture 19 faces the upper corner 13 of the pentagonal aperture 4 of the vertical joint 1 in the working position of the shelves.

In the event that the shelves have to withstand a heavy weight, the vertical joints can be reinforced by applying a reinforcement section 20, with a V cross-section, whose end portions of its branches 22 are parallel and whose vertex 21 is bevel-edged. This section 20 is adapted to be applied inside a vertical joint 1, so that the bevel-edged vertex 21 is adjacent to the inner face of the central branch of the vertical joint 1 and the parallel branches 22 of the reinforcement section 20 are adjacent to the respective side branches of vertical joint 1. In the plane determined by the bevel-edged vertex 21 of the section 20, there is a central series of aligned and equidistant orifices, whereas in the parallel branches 22, there are two pairs of side series of holes 23 aligned vertically and equidistant.

These orifices enable the reinforcement section 20 to be screwed through sets of screws and nuts 24 to the series of holes 11 of the central bridge 6 of the vertical joint 1 and of orifices 10 of grooves 9 of the side branches of the latter, respectively.

In order to splice two vertical joints 1 longitudinally, the join between both is made through an extender section 25, with a similar cross-section to the reinforcement section 20, but with its side branches 26 shorter and provided only with one series of holes. The extender section 25 (FIGS. 1 and 3) is adapted to be applied inside to two vertical joints 1 aligned longitudinally, so that when they are screwed tightly to these vertical joints 1 through sets of screws and nuts 24, they are stiffly joined together.

Figures 1, 2:
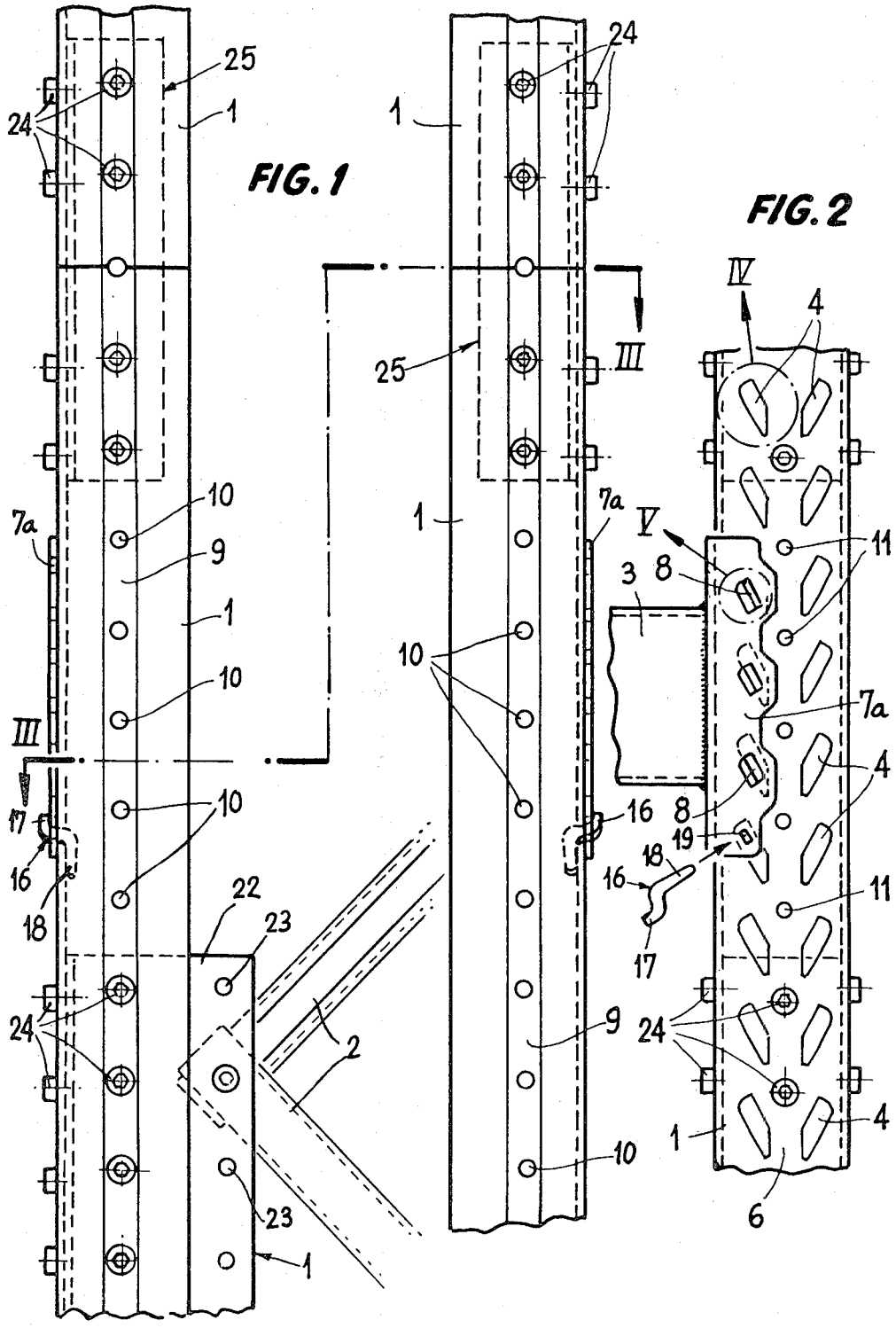
FIG. 1 is a side elevation view of two opposite portions of a vertical joint.
FIG. 2 shows a front elevation of a part of the vertical joint.

As can be seen in FIGS. 1 and 3, the braces 2 are screwed to the holes 23 of a reinforcement section branch 22, whereas in the embodiment illustrated in FIG. 6, the bracings 2 are screwed directly through orifices 10 of the grooves 9 in the vertical joint 1.

For a better support of the bottom end of the vertical joint 1 on the floor, which enables the vertical joints 1 to be fixed soundly to the ground, a base part 27 is arranged, made up of an essentially flat horizontal plate 28, provided with two wide transversal vertical wings 30, and a pressing plate fitted on top of the flat horizonal plate 28, with two longitudinal side walls 29, produced by bending the pressing plate upwards at its opposite ends. Two horizontal trapezoidal flanges 31 are produced by pressing in the vertical wings 30. The base part 27 is adapted to be applied under a vertical joint 1, like a sill, so that one of the side walls 29 is applied against the inner face of the central branch of the vertical joint 1 and that the trapezoidal flanges 31 are inserted in the grooves 9 of the side branches of the vertical joint 1. A pair of apertures 32 are made in each side wall 29, adapted to face a pair of pentagonal apertures 4 in the vertical joint 1 and thus to allow fixing through screws 33 of the base part 27 to this vertical joint 1. The base part 27 is provided with a longitudinal extension 34, horizontal and flat, having a hole 35 for fixing the base part 27 to the floor with screws 36 (FIG. 7).

Whatever does not alter, change or modify the essential features of the removable shelves disclosed, can be subject to variations in detail.

I claim:

1. A shelf rack, comprising:

a pair of profiled vertical joints with generally U-shaped cross-sections;

cross-member brace means for linking together the pair of profiled vertical joints to form a unit;

interlinkable longitudinal beam means for connecting together the pair of profiled vertical joints;

two longitudinal rows of slanted aperture means, provided along the length of each one of the pair of profiled vertical joints, for fitting together the pair of profiled vertical joints with the interlinkable longitudinal beam means, said aperture means by equidistant pairs converging symmetrically together downwards and each of said aperture means having a contour which takes the approximate shape of an irregular pentagon;

angular section means, provided at each end of the interlinkable longitudinal beam means, for fitting together the interlinkable longitudinal beam means with the pair of profiled vertical joints;

free wing means, included as a part of each of the angular section means, for jutting out in a plane parallel to the length of each one of the pair of profiled vertical joints;

tongue means, provided in said free wing means, for fitting into at least one of said aperture means; and safety bolt means, formed as a mainly S-shaped shank, for interlocking the tongue means into at least one of said aperture means, said safety bolt means having one end branch arranged to extend through the free wing means in which the tongue means is provided and having the other end branch arranged to extend through at least one of said aperture means.

2. The shelf rack, according to claim 1, wherein:

each of said aperture means has a large outer edge forming an obtuse angle close to 180° and having a gently rounded top corner.

3. The shelf rack, according to claim 1, wherein:

said tongue means has a free outer edge converging slightly towards a top edge and having a rounded top corner.

4. The shelf rack, according to claim 1, further comprising:

reinforcement means, adapted to fit inside the generally U-shaped cross-sections of the pair of profiled vertical joints, for interconnecting the pair of profiled vertical joints with the cross-member brace means.

5. The shelf rack, according to claim 1, further comprising:

extender means, adapted to fit inside the generally U-shaped cross-sections of the pair of profiled vertical joints, for connecting top ends of said pair of profiled vertical joints with bottom ends of another pair of profiled vertical joints to be seated on said top ends.

6. The shelf rack, according to claim 1, further comprising:

base means, arranged at bottom ends of said pair of profiled vertical joints, for supporting said pair of profiled vertical joints.

7. The shelf rack, according to claim 6, wherein:

said base means includes an essentially flat horizontal plate provided with two vertical wings and further includes a pressing plate being fitted on top of the essentially flat horizontal plate and being provided with two side walls produced by bending the pressing plate upwards at its opposite ends.

* * * * *